United States Patent [19]

Jones et al.

[11] 4,331,421

[45] May 25, 1982

[54] REVERSIBLE UNIDIRECTIONAL FLOW PUMP WITH AXIAL FRICTIONALLY ENGAGED RECESSED VALVE PLATE

[76] Inventors: Othel L. Jones, 1260 N. Kuther Rd.; Lawrence W. Cheney, Box 63, R.R. #5, both of Sidney, Ohio 45365

[21] Appl. No.: 256,859

[22] Filed: Apr. 23, 1981

Related U.S. Application Data

[63] Continuation of Ser. No. 44,345, May 31, 1979, abandoned.

[51] Int. Cl.[3] ..... F04C 15/02

[52] U.S. Cl. ..... 418/32

[58] Field of Search ..... 418/32; 417/315

[56] References Cited

U.S. PATENT DOCUMENTS

| | | | |
|---|---|---|---|
| 1,722,595 | 7/1929 | Rose | 417/315 |
| 2,151,482 | 3/1939 | Neeson | 417/315 |
| 2,751,145 | 6/1956 | Olcott | 418/32 |
| 2,855,139 | 10/1958 | Weibel, Jr. | 418/32 |
| 3,039,677 | 6/1962 | Nissley | 418/32 |
| 3,165,066 | 1/1965 | Phelps et al. | 418/32 |
| 3,208,392 | 9/1965 | Garrison et al. | 418/32 |
| 3,273,501 | 9/1966 | Tothero | 418/32 |
| 3,302,869 | 2/1967 | Tchen | 418/32 |
| 3,343,494 | 9/1967 | Erikson et al. | 418/32 |
| 3,418,939 | 12/1968 | Kopp | 418/32 |
| 3,478,693 | 11/1969 | Bangs | 418/32 |
| 3,796,523 | 3/1974 | Albrecht et al. | 418/32 |
| 3,985,473 | 10/1976 | King et al. | 417/315 |

FOREIGN PATENT DOCUMENTS

| | | | |
|---|---|---|---|
| 808088 | 7/1951 | Fed. Rep. of Germany | 418/32 |
| 869967 | 11/1941 | France | 418/32 |

*Primary Examiner*—John J. Vrablik

*Attorney, Agent, or Firm*—Harness, Dickey & Pierce

[57] ABSTRACT

A reversible positive displacement rotary fluid pump comprising a rotor with either dual sliding vanes or a single vane defining pumping cavities of increasing and decreasing volume and having a single non-valved inlet for both directions of rotation, outlet flow being controlled by a valve plate rotatable to one of two positions, as determined by the direction of rotation of the pump.

17 Claims, 7 Drawing Figures

FIG. 2.
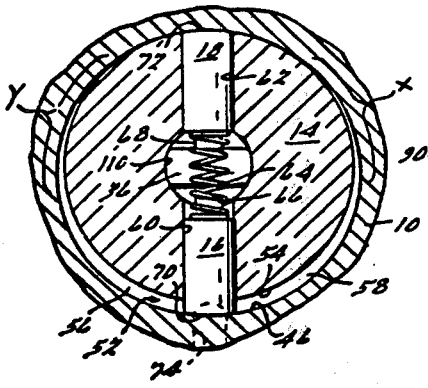
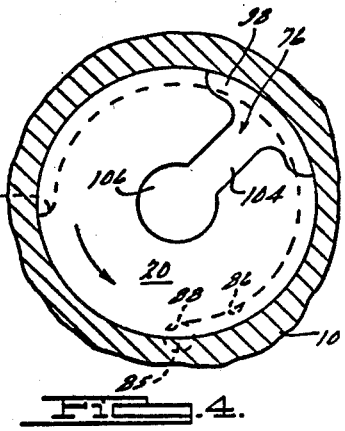
FIG. 4.
FIG. 3.
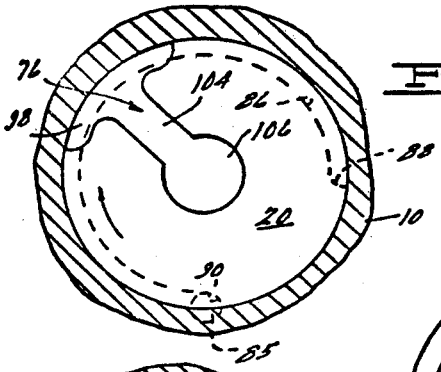
FIG. 5.
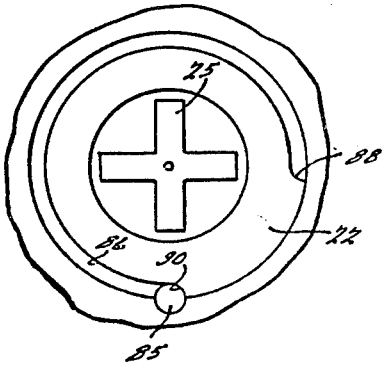
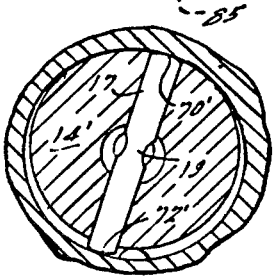
FIG. 6.

REVERSIBLE UNIDIRECTIONAL FLOW PUMP WITH AXIAL FRICTIONALLY ENGAGED RECESSED VALVE PLATE

This is a continuation of application Ser. No. 44,345, filed May 31, 1979, now abandoned.

BACKGROUND AND SUMMARY OF THE INVENTION

The present invention comprises an improvement of the subject matter of copending application Ser. No. 945,237, filed Sept. 25, 1978, and relates to a positive displacement rotary vane pump of the reversible type which automatically provides unidirectional discharge flow, regardless of direction of rotation. Reversible pumps are useful in many applications, such as for oil pumps for lubricating three-phase powered refrigeration compressors, which are run in clockwise or counterclockwise directions because the start-up of such compressors can result in rotation in either direction.

Rotary pumps adapted to provide unidirectional flow regardless of direction of rotation of the pump are known in the art. For example, U.S. patents disclosing reversible rotary vane pumps include U.S. Pat. Nos. 1,722,595 and 3,985,473. Other pumps providing unidirectional output include gear pumps, such as disclosed in U.S. Pat. Nos. 2,151,482; 3,165,066; 3,208,392; and 3,343,494. And a reversible shear pump is disclosed in U.S. Pat. No. 3,039,677.

It is an object of the present invention to provide an improved reversible, unitary flow pump, and particularly one which reliably has relatively few parts and can be economically constructed and maintained. A further object is to provide a rotary pump having improved automatic valve means comprising a single porting-/valve plate for providing unidirectional output regardless of direction of rotation. A related object concerns the provision of such a pump which does not require inlet valving.

These and other objects, features and advantages of the present invention will be apparent from the following description and appended claims, taken in conjunction with the accompanying drawings.

BRIEF DESCRIPTION OF THE DRAWINGS

FIG. 3 is a sectional view taken along line 3—3 of FIG. 1 showing the valve plate of the present invention in a counterclockwise position to accommodate one direction of rotation;

FIG. 4 is a view similar to FIG. 3 but showing the valve plate in a clockwise position to accommodate rotation in the opposite direction;

FIG. 5 is a sectional view taken along line 5—5 of FIG. 1;

FIG. 6 is a view similar to FIG. 2 illustrating a single vane embodiment of the present invention; and FIG. 7 is a detailed view similar to FIG. 1 showing the single vane embodiment illustrated in FIG. 6.

DESCRIPTION OF THE PREFERRED EMBODIMENTS

Figures 1, 2:
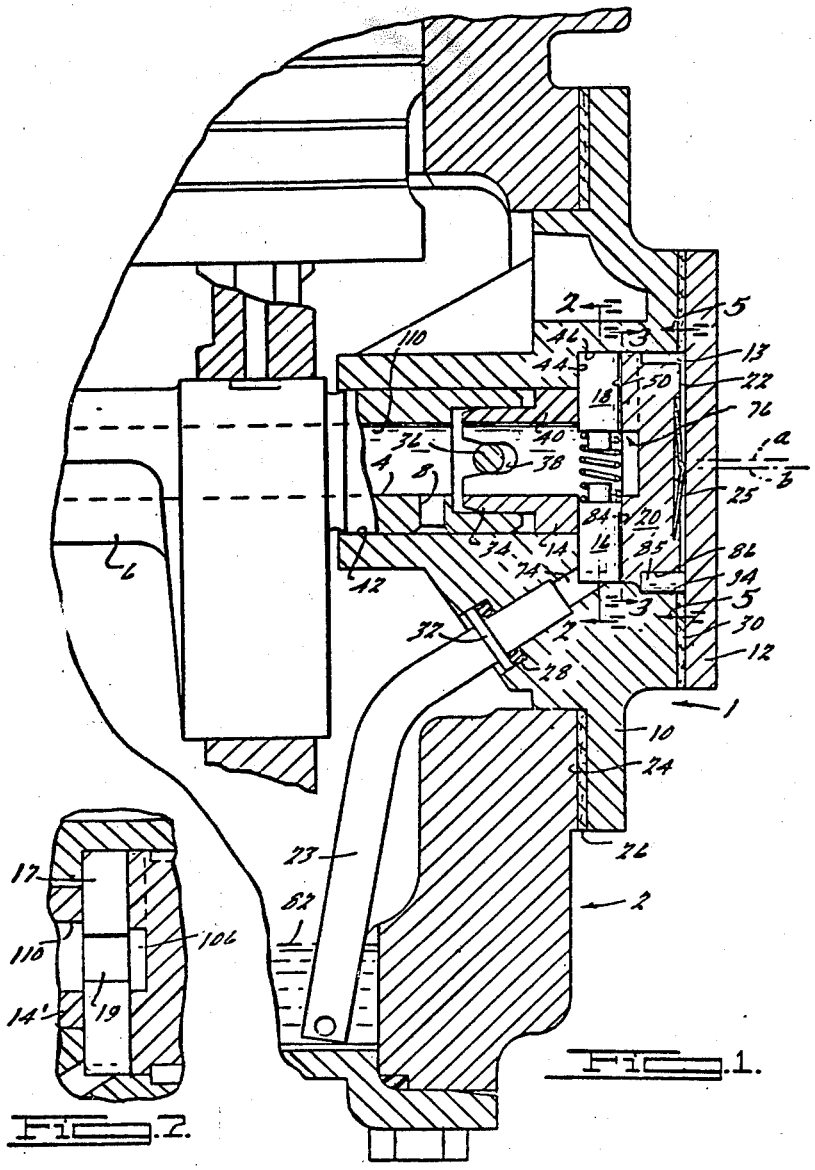
FIG. 1 is a vertical sectional view of a reversible fluid pump of the present invention in operative association with a compressor (partially shown)
FIG. 2 is a sectional view taken along line 2—2 of FIG. 1 illustrating the pumping chamber of the present invention.

The present invention relates to a novel rotary vane pump of the positive displacement type which provides a unidirectional output regardless of the direction of rotation of the shaft driving the pump. The pump features a single inlet port which is used for both directions of rotation. The pump also features an output valve means comprising a single outlet port in a movable valve plate, with the outlet port being aligned in a first position for one rotational direction and being aligned in a second position for the opposite rotational direction.

Now referring to the drawing, where like numbers refer to like parts in the various figures, a reversible pump 1 of the present invention is shown in FIG. 1. Pump 1 is shown in operative association with a refrigeration compressor 2 (such as one of the general type disclosed in U.S. Pat. No. 2,298,749) and has the function of supplying lubricating oil to bore 4 in compressor crankshaft 6. Lubricating oil is supplied to the various other parts of compressor 2 from bore 4 in a conventional manner. For example, one end of crankshaft 6 is lubricated by means of lubricating passage 8. Of course, it will be appreciated that pump 1 is suitable for other uses, which are all contemplated to be within the broad scope of this invention.

One of the advantages attendant to the present invention is that pump 1 comprises relatively few basic parts, and hence can be economically manufactured, assembled and maintained. The basic parts of pump 1 are a pump housing 10 which, in conjunction with a housing cover 12, encloses an impeller 14 having rotary vanes 16 and 18 slidably mounted thereon, a movable valve plate 20, an inlet tube 23, and a thrust washer 25 for biasing the valve plate 20 and impeller 14 against one another. The terms "axially", "radially", and "transversely" as used herein are with reference to the common axis of rotation of impeller 14 and compressor crankshaft 6, indicated at a in FIG. 1.

Pump housing 10 may be of any desired external configuration consistent with the use of pump 1. As shown in FIG. 1, pump housing 10 is mounted at the end of refrigeration compressor 2 and has a mounting surface 24 of a configuration adapted to fit upon the corresponding surfaces of compressor 2. It will be appreciated that other configurations adapted to fit other compressors or other apparatus are consistent with the present invention. In the particular embodiment of the present invention shown in FIG. 1, a conventional annular gasket 26 and O-ring 28 and gasket 30 are sealably disposed between pump housing 10 and compressor 2, between a flange 32 on tube 23 and housing 10, and between housing cover 12 and housing 10, respectively.

Pump housing 10 has centered on axis a a bore 42 in which the end of crankshaft 6 is disposed and an enlarged circular cylindrical bore 46 communicating therewith and centered on eccentric axis b, and a transverse shoulder 44 therebetween. Impeller 14, which has vanes 16 and 18 mounted thereon, and valve plate 20 are disposed within bore 46. Impeller 14 is rotatably driven by compressor crankshaft 6, which fits coaxially over a reduced diameter cylindrical end portion 34 of impeller 14. Relative rotation between crankshaft 6 and impeller 14 is prevented by a pin 36 which extends transversely through compressor crankshaft 6 and fits into notches 38 in end portion 34.

As shown in FIGS. 1 and 2, shoulder 44 and eccentric bore 46 of valve housing 10 cooperate with inner face 50 of movable valve plate 20 and outer peripheral surface 54 of impeller 14 to define a pumping cavity 52. Pumping cavity 52 is divided into two rotating pumping chambers 56 and 58 by means of opposed vanes 16 and 18 which are slidably carried in radially outwardly extending slots 60 and 62 in impeller 14. Vanes 16 and 18 are biased radially outwardly against the surface of bore 56 by a compression spring 64 which fits over reduced end portions 66 and 68 of vanes 16 and 18. Thus, outer ends 70 and 72 of vanes 16 and 18 are maintained in continuous sealing engagement with the wall of bore 46.

The flow of fluid into and out of pumping cavity 52 is provided by means of an inlet port 74 communicating with cavity 52 through shoulder 44, and outlet port 76 in movable valve plate 20. Inlet tube 23 extends from oil reservoir or sump 82 into housing 10 where it communicates with inlet port 74. The lower end of tube 23 is in fluid communication with oil in sump 82.

Movable valve plate 20 is adapted for limited rotational movement in response to the frictional force exerted on face 50 by outer face 84 of impeller 14 when rotating in a clockwise or counterclockwise direction. Rotation of movable valve plate 20 in both directions is limited by suitable stop means, such as a pin 85 which extends into a channel 86 having ends 88 and 90 and located at the periphery of movable valve plate 20. Thrust washer 25 operates between cover 12 and valve plate 20 to cause the latter to be spaced from cover 12 and biased against impeller 14 to create the friction necessary to cause the impeller to give limited rotation to the valve plate 20. As best seen in FIGS. 1 and 5, thrust washer 25 has a plurality of radially outwardly extending legs, the ends of which engage valve plate 20, and in the center an outwardly projecting boss which engages cover 12.

At this point, it will be noted that the relative sizes of the friction bearing surfaces between impeller 14 and movable valve plate 20 on the one hand and movable valve plate 20 (via thrust washer 25) and cover 12 on the other hand ensure a positive actuating movement of the valve plate. In particular, as can best be seen from FIG. 1, the contact area between inner face 50 of movable valve plate 20 and face 84 of impeller 14 is substantially greater, and at a greater radius from axis a, than the area of thrust washer 25 which abuts against the inside surface 13 of the cover 12 (as well as that of any other frictional surfaces resisting such movement). Consequently, it will be appreciated that the frictional driving force applied by impeller 14 to the inner face 50 of movable valve plate 20 will easily overcome the frictional resistance to such movement. Accordingly, positive actuating movement of valve plate 20 is ensured.

Outlet port 76 comprises a recessed area in the inner face 50 of valve plate 20 consisting of an arcuate portion 98 at the periphery of the valve plate which communicates with a channel 104 that extends radially inwardly to a central depression 106. The arcuate portion 98 of outlet port 76 serves to provide a discharge zone of sufficient length to obtain efficient pumping. The central depression 106 of outlet port 76 in turn is aligned with a central bore 110 through impeller 14, which communicates with bore 4 of compressor crankshaft 6 and hence the lubrication network of compressor 2. Bore 110 also acts as a bearing support for impeller 14, which has the advantage that the pump can be tested independently of the compressor.

A further appreciation of the present invention will be obtained from the following description of the operation of pump 1. In accordance with the invention, upon rotation of compressor crankshaft 6, say in a counterclockwise direction as viewed from the left in FIG. 1, impeller 14 will be similarly driven. Friction between face 84 of impeller 14 and face 50 of movable valve plate 20 will rotate valve plate 20 in its counterclockwise position shown in FIG. 4, with stop pin 85 abutting against end 88 of groove 86. Continued counterclockwise rotation of impeller 14 causes oil to be pumped from reservoir 82 into pumping cavity 52 and out through recessed outlet port 76, via arcuate portion 98, of channel 104, central depression 106, bore 108, bore 110 and into port 4 of crankshaft 6, in the following manner.

Referring to FIG. 2 it can be seen that vanes 16 and 18 divide pumping cavity 52 into two rotating pumping chambers 56 and 58, each of which is of increasing and decreasing volume as impeller 14 rotates. In FIG. 2, vane 16 is shown at inlet port 74 and pumping chambers 56 and 58 are shown as being of equal volume. The discharge zone indicated at Y is the one provided by recessed outlet port 76 when valve plate 20 is in its counterclockwise position illustrated in FIG. 4. Similarly, the discharge zone X is provided by recessed outlet port 76 when valve plate 20 is in its clockwise position illustrated in FIG. 3. As impeller 14 and vane 16 rotate past inlet port 74 in the counterclockwise direction, as viewed in FIGS. 3 and 4 (clockwise as viewed in FIG. 2), pumping chamber 56 will decrease in size and pumping chamber 58 will increase in size with the result that fluid will be pulled into pumping chamber 58 from oil reservoir 82 through inlet port 74 until vane 16 reaches discharge zone Y, at which point pumping chamber 58 will be of maximum volume. Further rotation of impeller 14 will cause pumping chamber 58 to decrease in volume, forcing fluid out through recessed outlet port 76. Although fluid will also be discharged through inlet port 74, probably because of the dynamics of the system, this does not seem to seriously hinder successful operation of the pump. Upon further rotation of impeller 14, vane 18 will pass inlet port 74 and thereafter all the remaining fluid in chamber 56 will be pumped out through recessed outlet port 76, this cycle continuing until vane 18 has passed the arcuate portion 98 of outlet port 76 (zone Y). Between this position (the trailing vane having just passed the discharge port) and the position in which the leading vane passes the inlet port 74, rotation of the impeller causes a vacuum to be created in chamber 58, so that when the inlet port 74 is opened a substantial pressure differential exists to accelerate fluid induction. The pumping processes of pumping chambers 56 and 58 are identical (merely 180° out of phase), so that two discharge cycles will occur each revolution of impeller 14. The construction of pump 1 allows use of a single inlet port, which is one of the unique and desirable features of the present invention because of the simplicity it provides.

As can be readily visualized, upon rotation of compressor crankshaft 6 in the opposite direction, valve plate 20 will be rotated approximately 270° to its clockwise position illustrated in FIG. 3 and fluid will be pumped outwardly through recessed outlet port 76 in an analagous fashion.

Turning now to FIGS. 6 and 7, an alternative embodiment of the reversible pump 1 of the present invention is shown utilizing a one-piece vane impeller 14'. In particular, impeller 14' in this embodiment utilizes a single rotary vane 17 mounted thereon which extends radially across the diameter of eccentric bore 46 so that the outer ends thereof 70' and 72' maintain a continuous sealing engagement with the wall of bore 46 as impeller 14' is rotated. In addition, the one-piece rotary vane 17 has a reduced cross-sectional central portion 19 which permits the flow of fluid from the central depression 106 of outlet port 76 in movable valve plate 20 past rotary vane 17 and into bore 110 of impeller 14' and port 4 of crankshaft 6. It will be appreciated that in all other respects, operation of impeller 14' of this embodiment is the same as that described for the operation of impeller 14.

Thus, there is disclosed in the above description and in the drawings an improved reversible pump which fully and effectively accomplishes the objectives thereof. However, it will be apparent that variations and modifications of the disclosed embodiments may be made without departing from the principles of the invention or the scope of the appended claims.

What is claimed is:

1. In a reversible, rotary fluid pump including a housing defining a pumping chamber, fluid inlet means communicating with said pumping chamber, fluid outlet means, rotary pumping means disposed within said pumping chamber, and a shaft for driving said pumping means; the improvement comprising:

a single fixed inlet port communicating with said pumping chamber and with said pumping means in all operable conditions of said pumping means;

a fluid inlet passageway in fluid communication with said inlet port; and valving means between said rotary pumping means and said fluid outlet means solely comprising a movable valve plate having a face thereof in frictional engagement with said rotary pumping means and adapted for limited rotational movement to one of two operative positions in accordance with the direction of rotation of said pumping means, said valve plate having a recessed outlet port formed in said face for providing fluid communicating from said pumping chamber to said outlet means in both of said operative positions, said recessed outlet port comprising an arcuate-shaped portion adjacent the periphery of said valve plate which communicates with said pumping chamber, a central portion which communicates with said outlet means, and a radial portion communicating between said arcuated shaped portion and said central portion.

2. The fluid pump of claim 1 further including stop means for limiting clockwise and counterclockwise rotation of said valve plate between said two operative positions.

3. The fluid pump of claim 1 wherein said pumping means comprises a rotatable rotor positioned in said pumping chamber, said rotor having a vane outwardly slidably attached thereto and in sealing and slidable contact with the inner wall of said pumping chamber, said pumping chamber, rotor and vane defining a pumping cavity of increasing and decreasing displacement when said rotor rotates.

4. The fluid pump of claim 3 wherein said outlet port of said valve plate communicates with said pumping chamber at a point wherein said cavity approaches minimum displacement.

5. The fluid pump of claim 4 wherein said inlet means communicates with said pumping chamber at the midpoint of said cavity when said cavity is at maximum displacement.

6. In a reversible, rotary fluid pump including a housing defining a pumping chamber, fluid outlet means, rotary pumping means disposed within said pumping chamber rotating about an axis, and a shaft for driving said pumping means; the improvement comprising:

a single fixed inlet port communicating with said pumping chamber and with said pumping means in all operable conditions of said pumping means;

a fluid inlet passageway in fluid communication with said inlet port; and a movable valve plate disposed in frictional engagement with said pumping means, axially disposed from said pumping means, and being adapted for limited rotational movement to one of two operative positions in accordance with the direction of rotation of said pumping means, said valve plate having a passageway formed therein for directing fluid flow from said pumping chamber directly to said fluid outlet means in both of said operative positions, said valve plate passageway including an outlet port comprising a recessed area formed in said valve plate consisting of a first portion adjacent the periphery of said valve plate, a central portion, and a radial portion communicating between said first and central portions, said first portion being arcuate in shape, said arcuate shaped portion communicating with said pumping chamber and said central portion communicating with said outlet means.

7. The fluid pump of claim 6 wherein said outlet means comprises a passageway extending along the axis of said shaft.

8. The fluid pump of claim 7 wherein said shaft is hollow and said passageway comprises the interior of said shaft.

9. The fluid pump of claim 6 wherein said recessed outlet port is formed in the face of said valve plate frictionally engaged with said pumping means.

10. The fluid pump of claim 9 further including spring means for biasing said valve plate against said pumping means.

11. In a reversible, rotary fluid pump including a housing defining a pumping chamber, fluid outlet means, rotary pumping means disposed within said pumping chamber rotating about an axis, and a shaft for driving said pumping means; the improvement comprising:

a single fixed inlet port communicating with said pumping chamber and with said pumping means in all operable conditions of said pumping means;

a fluid inlet passageway in fluid communication with said inlet port; and a movable valve plate disposed in frictional engagement with said pumping means, axially disposed from said pumping means, and being adapted for limited rotational movement to one of two operative positions in accordance with the direction of rotation of said pumping means, said valve plate having a passageway formed therein for directing fluid flow from said pumping chamber directly to said fluid outlet means in both of said operative positions, said pumping means comprising a rotatable rotor positioned in said pumping chamber, said rotor having a vane outwardly slidably attached thereto and in sealing and slidable contact with the inner wall of said pumping chamber, said pumping chamber, rotor and vane defining a pumping cavity of increasing and decreasing displacement when said rotor rotates.

12. The fluid pump of claim 11 further including stop means for limiting clockwise and counterclockwise rotation of said valve plate between said two operative positions.

13. The fluid pump of claim 11 wherein said valve plate passageway includes an outlet port comprising a recessed area formed in said valve plate.

14. The fluid pump of claim 13 wherein said recessed area consists of a first portion adjacent the periphery of said valve plate, a central portion and a radial portion communicating between said first and central portions.

15. The fluid pump of claim 14 wherein said first portion is arcuate in shape.

16. The fluid pump of claim 11 wherein said outlet port of said valve plate communicates with said pumping chamber at a point wherein said cavity approaches minimum displacement.

17. The fluid pump of claim 16 wherein said inlet means communicates with said pumping chamber at the midpoint of said cavity when said cavity is at maximum displacement.

* * * * *